US010358688B2

(12) United States Patent
Kitsuya et al.

(10) Patent No.: US 10,358,688 B2
(45) **Date of Patent: *Jul. 23, 2019**

(54) STEEL PLATE AND METHOD OF PRODUCING SAME

(71) Applicant: JFE Steel Corporation, Tokyo (JP)

(72) Inventors: Shigeki Kitsuya, Tokyo (JP); Katsuyuki Ichimiya, Tokyo (JP); Kazukuni Hase, Tokyo (JP); Shigeru Endo, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 324 days.

This patent is subject to a terminal disclaimer.

(21) Appl. No.: 15/304,702

(22) PCT Filed: Apr. 24, 2015

(86) PCT No.: PCT/JP2015/002244

§ 371 (c)(1),
(2) Date: Oct. 17, 2016

(87) PCT Pub. No.: WO2015/162939

PCT Pub. Date: Oct. 29, 2015

(65) Prior Publication Data

US 2017/0044639 A1 Feb. 16, 2017

(30) Foreign Application Priority Data

Apr. 24, 2014 (JP) ..... 2014-090623

(51) Int. Cl.

| | |
|---|---|
| ***C21D 9/46*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/14*** | (2006.01) |
| ***C22C 38/16*** | (2006.01) |
| ***C22C 38/42*** | (2006.01) |
| ***C22C 38/44*** | (2006.01) |
| ***C22C 38/50*** | (2006.01) |
| ***C22C 38/54*** | (2006.01) |
| ***C22C 38/58*** | (2006.01) |
| ***B21B 1/22*** | (2006.01) |
| ***B21B 1/26*** | (2006.01) |
| ***C22C 38/00*** | (2006.01) |
| ***C22C 38/46*** | (2006.01) |
| ***C22C 38/48*** | (2006.01) |
| *B21B 3/00* | (2006.01) |

(52) U.S. Cl.

CPC ..... *C21D 9/46* (2013.01); *B21B 1/22* (2013.01); *C21D 8/02* (2013.01); *C21D 8/0205* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/14* (2013.01); *C22C 38/16* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *B21B 1/26* (2013.01); *B21B 3/00* (2013.01); *B21B 2001/225* (2013.01); *C21D 2211/002* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 7,914,629 | B2 | 3/2011 | Nakashima et al. | |
| 8,608,871 | B2 | 12/2013 | Ishiguro et al. | |
| 10,000,833 | B2 * | 6/2018 | Kitsuya ..... | C22C 38/58 |
| 2014/0246131 | A1 | 9/2014 | Yuga et al. | |
| 2015/0203945 | A1 | 7/2015 | Ichimiya et al. | |

(Continued)

FOREIGN PATENT DOCUMENTS

| | | | |
|---|---|---|---|
| CN | 101341269 | A | 1/2009 |
| CN | 101962741 | | 2/2011 |
| CN | 102176985 | A | 9/2011 |
| CN | 102605280 | | 7/2012 |
| CN | 102712972 | A | 10/2012 |
| CN | 103710640 | A | 4/2014 |
| JP | S55-114404 | A | 9/1980 |
| JP | 58-31069 | | 2/1983 |
| JP | S61-27320 | A | 2/1986 |
| JP | 1-219121 | A | 9/1989 |
| JP | H02-197383 | A | 8/1990 |
| JP | H04-190902 | A | 7/1992 |
| JP | H06-198394 | A | 7/1994 |
| JP | H10-88231 | A | 4/1998 |
| JP | 2913426 | | 6/1999 |

(Continued)

OTHER PUBLICATIONS

English translation of JP 5354164, Jun. 2010; 19 pages.*

(Continued)

*Primary Examiner* — Helene Klemanski
(74) *Attorney, Agent, or Firm* — DLA Piper LLP (US)

(57) ABSTRACT

A steel plate has excellent strength and toughness in a mid-thickness part thereof, despite having a plate thickness of 100 mm or greater. The steel plate has a chemical composition containing specific amounts of C, Si, Mn, P, S, Cr, Ni, Al, N, B, and O, with the balance being Fe and incidental impurities, and having an equivalent carbon content $Ceq^{IIW}$ of 0.65 or greater. The steel plate has a yield strength of 620 MPa or greater, a plate thickness of 100 mm or greater, and has a microstructure in which prior γ grain size in a mid-thickness part of the steel plate has a maximum value, expressed as an equivalent circle diameter, of 150 μm or less, and a total area ratio of martensite and bainite in the mid-thickness part is 80% or greater.

4 Claims, No Drawings

(56) References Cited

U.S. PATENT DOCUMENTS

| | | | |
|---|---|---|---|
| 2016/0010192 | A1 | 1/2016 | Kitsuya et al. |
| 2017/0088913 | A1* | 3/2017 | Kitsuya ..... C22C 38/58 |

FOREIGN PATENT DOCUMENTS

| | | | |
|---|---|---|---|
| JP | 2000-263103 | A | 9/2000 |
| JP | 2002-194431 | A | 7/2002 |
| JP | 2002-210502 | A | 7/2002 |
| JP | 2002-256380 | A | 9/2002 |
| JP | 3333619 | B2 | 10/2002 |
| JP | 2005-68519 | A | 3/2005 |
| JP | 2006-111918 | A | 4/2006 |
| JP | 2008-308736 | A | 12/2008 |
| JP | 2009-235524 | A | 10/2009 |
| JP | 2010-106298 | A | 5/2010 |
| JP | 2010-280976 | A | 12/2010 |
| JP | 2011-202214 | A | 10/2011 |
| JP | 2013/91845 | | 5/2013 |
| JP | 2013-95927 | A | 5/2013 |
| JP | 5354164 | | 11/2013 |
| JP | 2014-38200 | A | 2/2014 |
| JP | 5477457 | | 4/2014 |
| WO | 2013/051231 | | 4/2013 |
| WO | 2014/141697 | A1 | 9/2014 |
| WO | WO 2015/140846 | A1 * | 9/2015 |

OTHER PUBLICATIONS

Canadian Office Action dated Nov. 28, 2017, of corresponding Canadian Application No. 2,945,439.

Supplementary European Search Report dated Jan. 12, 2017, of corresponding European Application No. 15783445.8.

Korean Office Action dated Jan. 3, 2018, of corresponding Korean Application No. 10-2016-7030757, along with a Concise Statement of Relevance of Office Action in English.

European Office Action dated Jan. 31, 2018, of corresponding European Application No. 15 783 445.8.

K. Otani et al., "Development of Ultra-Heavy Gauge (210 mm Thick) 800N/mm$^2$ Class Steel Plate for Racks of Jack-up Rigs", *Nippon Steel Technical Report No. 348*, 1993, pp. 10-16, with English abstract.

H. Tagawa et al., "Development of High Strength Steel Plates for Arctic Uses Manufactured by Quenching and Tempering Process", *NKK Corporation Technical Review No. 107*, 1985, pp. 21-30, with English abstract.

Office Action dated Aug. 23, 2017, of corresponding Chinese Application No. 201580021160.7, along with an English translation of the Search Report.

Office Action dated Nov. 13, 2018, of counterpart Chinese Application No. 201580021160.7, along with a Search Report in English.

The Fourth Office Action dated May 5, 2019, of counterpart Chinese Application No. 201580021160.7, including a translation of Office Action in English.

* cited by examiner

STEEL PLATE AND METHOD OF PRODUCING SAME

TECHNICAL FIELD

This disclosure relates to a steel plate suitable for use in steel structures such as buildings, bridges, ships, offshore structures, construction machinery, tanks, and penstocks, and to a method of producing the steel plate.

BACKGROUND

In various fields such as buildings, bridges, ships, offshore structures, construction machinery, tanks, and penstocks, steel materials are welded in accordance with shapes of steel structures to form desired shapes. In recent years there has been remarkable development in the production of larger scale steel structures, and thus there has been significant progress toward higher strength and thicker steel materials used to produce such steel structures.

However, when attempting to produce a steel plate having a thickness of 100 mm or greater and also having excellent strength and toughness in a mid-thickness part thereof, the large thickness of the steel plate causes the thickness central part to experience a lower cooling rate, which facilitates formation of a microstructure such as ferrite that has relatively low strength. Consequently, it is necessary to add large amounts of alloying elements to inhibit formation of such a microstructure.

It is particularly important to form a bainite microstructure or a mixed microstructure of bainite and martensite in the mid-thickness part during quenching to improve strength and toughness of a mid-thickness part of a steel plate. Accordingly, it is necessary to add large amounts of alloying elements such as Mn, Ni, Cr, and Mo.

Publications related to such steel plates include Nippon Steel Technical Report No. 348 (1993), p. 10-16 and NKK Corporation Technical Review No. 107 (1985), p. 21-30. Nippon Steel Technical Report No. 348 (1993), p. 10-16 describes a steel plate having a plate thickness of 210 mm and NKK Corporation Technical Review No. 107 (1985), p. 21-30 describes a steel plate having a plate thickness of 180 mm.

However, when large amounts of alloying elements such as Mn, Ni, Cr, and Mo are added to improve the microstructure of a mid-thickness part as described above, there is a problem that even if heat treatment is carried out with an objective of refining and homogenizing prior γ grain size, the desired refinement of prior γ grain size may not occur and, as a result, it may not be possible to obtain adequate toughness in the mid-thickness part.

We believe that the phenomenon described above occurs due to a shear-type reverse transformation. Specifically, nucleation and growth of γ grains normally occur from prior γ grain boundaries during heating of a steel material, and refinement and homogenization of prior γ grain size occur in association therewith. However, in a situation in which large amounts of alloying elements are contained in the steel material, nucleation and growth of γ grains are less likely to occur as described above and a shear-type reverse transformation may occur in which the prior γ grains themselves undergo a sudden reverse transformation to austenite. Consequently, γ grains remain coarse in a part of the steel material in which this reverse transformation occurs. Moreover, bainite and martensite obtained by cooling from this state are also coarse.

However, Nippon Steel Technical Report No. 348 (1993), p. 10-16 and NKK Corporation Technical Review No. 107 (1985), p. 21-30 do not describe a technique that resolves the difficulty of refining prior γ grain size during heat treatment. Therefore, a need remains to reliably produce steel plates having excellent strength and toughness in a mid-thickness part thereof.

It could therefore be helpful to provide a steel plate having excellent strength and toughness in a mid-thickness part thereof, despite having a plate thickness of 100 mm or greater, and to provide a method of producing such a steel plate.

SUMMARY

We thus provide:

1. A steel plate having;

a chemical composition containing (consisting of), by mass %:

0.08% to 0.20% of C;
0.40% or less of Si;
0.5% to 5.0% of Mn;
0.015% or less of P;
0.0050% or less of S;
0% to 3.0% of Cr;
0% to 5.0% of Ni;
0% to 0.080% of Al;
0.0070% or less of N;
0.0030% or less of B;
0.0025% or less of 0, and the balance being Fe and incidental impurities, wherein the chemical composition satisfies a relationship (1) shown below, $$Ceq^{IW}=[\%\ C]+[\%\ Mn]/6+([\%\ Cu]+[\%\ Ni])/15+([\%\ Cr]+[\%\ Mo]+[\%\ V])/5\geq 0.65 \quad (1)$$

where [% M] indicates content of an element M in the steel plate by mass % and has a value of 0 in a situation in which the element M is not contained in the steel plate, a microstructure in which:

prior γ grain size in a mid-thickness part of the steel plate has a maximum value, expressed as an equivalent circle diameter, of 150 μm or less; and a total area ratio of martensite and bainite in the mid-thickness part is 80% or greater, and a yield strength of 620 MPa or greater and a plate thickness of 100 mm or greater.

2. The steel plate described in 1, wherein the chemical composition further contains, by mass %, one or more selected from:

0.50% or less of Cu;
1.50% or less of Mo;
0.200% or less of V; and
0.005% to 0.020% of Ti.

3. The steel plate described in 1 or 2, wherein the chemical composition further contains, by mass %, one or more selected from:

0.0001% to 0.002% of Mg;
0.01% to 0.20% of Ta;
0.005% to 0.1% of Zr;
0.001% to 0.01% of Y;
0.0005% to 0.0050% of Ca; and
0.0005% to 0.0100% of REMs.

4. A method of producing the steel plate described in any one of 1-3, comprising:

heating a semi-finished casting product having the chemical composition described in any one of 1-3 to at least an $Ac_3$ temperature and no higher than 1200° C.;

subsequently subjecting the semi-finished casting product to three or more passes of hot rolling to obtain a steel plate having a plate thickness of 100 mm or greater;

subsequently reheating the steel plate to at least the $Ac_3$ temperature and no higher than 1050° C.;

subsequently rapidly cooling the steel plate to 350° C. or lower from a temperature equal to or higher than an $Ar_3$ temperature; and subsequently subjecting the steel plate to a tempering process at a temperature of at least 450° C. and no higher than 700° C., wherein in a situation in which the hot rolling consists of three or four passes, at least one pass is performed with a rolling reduction of 8% or greater and at least one other pass is performed with a rolling reduction of 15% or greater, and in a situation in which the hot rolling consists of five or more passes, at least three of the last five passes are each performed with a rolling reduction of 8% or greater.

A steel plate can thus be obtained having excellent strength and toughness in a mid-thickness part thereof and having excellent strength and toughness throughout the steel despite having a plate thickness of 100 mm or greater. Therefore, we make a significant contribution to increasing the scale and improving the safety of steel structures and have a considerable effect in industry.

DETAILED DESCRIPTION

We carefully considered steel plates having a yield strength of 620 MPa or greater and a plate thickness of 100 mm or greater and focused on factors that can be used to control internal microstructure of a steel plate to obtain excellent strength and toughness in a mid-thickness part of the steel plate. We thus found that:

(1) To obtain good strength and toughness in a mid-thickness part of a steel plate in which the cooling rate is considerably lower than at the surface of the steel plate, it is important to appropriately select the chemical composition of the steel plate so that a martensite and/or bainite microstructure is formed as the microstructure even at the lower cooling rate.

(2) It is necessary for a steel plate having a plate thickness of 100 mm or greater to have a large alloy content to obtain the same microstructure as described above. However, an equivalent carbon content of 0.65% or greater makes the phenomenon in which refinement of prior γ grain size becomes more difficult in heat treatment particularly likely to occur, and makes it difficult to ensure reliable toughness.

(3) It is important to refine prior γ grain size before heat treatment—in other words, prior γ grain size directly after hot rolling—to refine prior γ grain size after the heat treatment. Accordingly, selection of appropriate hot rolling conditions is important.

(4) Simply reducing the average value of prior γ grain size is insufficient to enhance toughness of a mid-thickness part of a steel plate. It is vital to also reduce the maximum grain size.

The chemical composition of our steel plates will now be explained. Note that the content of each element is by mass %. C: 0.08% to 0.20%

C is a useful element to cheaply obtain strength required for structural-use steel. Accordingly, C content is 0.08% or greater. On the other hand, C content of greater than 0.20% causes noticeable deterioration in steel plate and heat-affected zone toughness. Accordingly, the C content is 0.20% or less. The C content is preferably 0.08% to 0.14%.

Si: 0.40% or less

Si is added for the purpose of deoxidation, but causes noticeable deterioration in steel plate and heat-affected zone toughness if Si content is greater than 0.40%. Accordingly, the Si content is 0.40% or less. The Si content is preferably 0.05% to 0.30% and more preferably 0.10% to 0.30%.

Mn: 0.5% to 5.0%

Mn is added from a viewpoint of ensuring steel plate strength and toughness, but this effect is not sufficiently obtained when Mn content is less than 0.5%. On the other hand, Mn content of greater than 5.0% not only causes deterioration of steel plate toughness, but also promotes central segregation and increases the scale of slab porosity. Accordingly, the Mn content is 5.0% or less. The Mn content is preferably 0.6% to 2.0% and more preferably 0.6% to 1.6%.

P: 0.015% or Less

P content of greater than 0.015% causes noticeable deterioration in steel plate and heat-affected zone toughness. Accordingly, the P content is limited to 0.015% or less. However, it is not essential that P is contained in the chemical composition.

S: 0.0050% or Less

S content of greater than 0.0050% causes noticeable deterioration in steel plate and heat-affected zone toughness. Accordingly, the S content is limited to 0.0050% or less. However, it is not essential that S is contained in the chemical composition.

Cr: 3.0% or Less (inclusive of 0%)

Cr is an effective element to increase steel plate strength, but reduces weldability if added in a large amount. Accordingly, Cr content is 3.0% or less. The Cr content is preferably 0.1% to 2.0%. However, it is not essential that Cr is contained in the chemical composition.

Ni: 5.0% or Less (Inclusive of 0%)

Ni is a beneficial element to improve steel plate strength and heat-affected zone toughness. However, Ni content of greater than 5.0% has a noticeable negative effect on cost efficiency. Accordingly, the Ni content is 5.0% or less. The Ni content is preferably 0.5% to 4.0%. However, it is not essential that Ni is contained in the chemical composition.

Al: 0.080% or Less (Inclusive of 0%)

Al is added to sufficiently deoxidize molten steel. However, Al content of greater than 0.080% increases the amount of dissolved Al in the steel plate and reduces steel plate toughness. Accordingly, the Al content is 0.080% or less. The Al content is preferably 0.030% to 0.080% and more preferably 0.030% to 0.060%. However, it is not essential that Al is contained in the chemical composition.

N: 0.0070% or Less

N has an effect of improving steel plate and heat-affected zone toughness by refining the microstructure through formation of nitrides with Ti and the like. However, N content of greater than 0.0070% increases the amount of dissolved N in the steel plate, noticeably reduces steel plate toughness, and further reduces heat-affected zone toughness by also forming coarse carbonitrides in the heat-affected zone. Accordingly, the N content is 0.0070% or less. The N content is preferably 0.0010% to 0.0050% and more preferably 0.0010% to 0.0040%.

B: 0.0030% or Less

B has an effect of increasing quench hardenability by segregating at austenite grain boundaries to inhibit ferrite transformation from the grain boundaries. However, B content of greater than 0.0030% reduces quench hardenability due to precipitation of B as a carbonitride and, consequently, reduces toughness. Accordingly, the B content is 0.0030% or less. The B content is preferably 0.0003% to 0.0030% and more preferably 0.0005% to 0.0020%.

O: 0.0025% or Less

O content of greater than 0.0025% causes formation of hard oxides in the steel plate and noticeably reduces toughness. Accordingly, the O content is 0.0025% or less. The O content is preferably 0% to 0.0020%.

A steel plate according to one example is composed of the basic elements described above, with the balance being Fe and incidental impurities.

In another example, in addition to the basic elements described above (i.e., in place of a portion of the Fe making up the balance), the chemical composition may further contain one or more selected from Cu, Mo, V, and Ti with an objective of increasing strength and toughness.

Cu: 0.50% or Less

Cu is a useful element to improve steel plate strength without reducing toughness, but causes cracks to occur in the surface of the steel plate during hot working if Cu content is greater than 0.50%. Accordingly, the Cu content is preferably 0.50% or less in a situation in which Cu is added.

Mo: 1.50% or Less

Mo is an effective element to increase steel plate strength, but increases hardness due to alloy carbide precipitation and reduces toughness if Mo content is greater than 1.50%. Accordingly, the Mo content is preferably 1.50% or less in a situation in which Mo is added. The Mo content is more preferably 0.020% to 0.80%.

V: 0.200% or Less

V has an effect of improving steel plate strength and toughness and effectively lowers the amount of dissolved N by precipitating as VN. However, V content of greater than 0.200% reduces toughness due to precipitation of hard VC. Accordingly, the V content is preferably 0.200% or less in a situation in which V is added. The V content is more preferably 0.010% to 0.100%.

Ti: 0.005% to 0.020%

Ti forms TiN during heating, effectively inhibits coarsening of austenite, and improves steel plate and heat-affected zone toughness. However, Ti content of greater than 0.020% causes coarsening of Ti nitrides and reduces steel plate toughness. Accordingly, Ti content is preferably 0.005% to 0.020% in a situation in which Ti is added. The Ti content is more preferably 0.008% to 0.015%.

In another example, in addition to the basic elements described above (i.e., in place of a portion of the Fe making up the balance), the chemical composition may further contain one or more selected from Mg, Ta, Zr, Y, Ca, and REMs with an objective of further enhancing material properties.

Mg: 0.0001% to 0.002%

Mg forms a stable oxide at high temperature, effectively inhibits coarsening of prior γ grains in a heat-affected zone, and is an effective element to improve weld toughness, but these effects are poorly obtained if Mg content is less than 0.0001%. On the other hand, Mg content of greater than 0.002% increases the amount of inclusions and reduces toughness. Accordingly, the Mg content is preferably 0.0001% to 0.002% in a situation in which Mg is added. The Mg content is more preferably 0.0001% to 0.015%.

Ta: 0.01% to 0.20%

Ta effectively improves strength when added, but this effect is poorly obtained if Ta content is less than 0.01%. On the other hand, Ta content of greater than 0.20% reduces toughness due to precipitate formation. Accordingly, the Ta content is preferably 0.01% to 0.20% in a situation in which Ta is added.

Zr: 0.005% to 0.1%

Zr is an effective element to improve steel plate strength, but this effect is poorly obtained if Zr content is less than 0.005%. On the other hand, Zr content of greater than 0.1% causes formation of a coarse precipitate and reduces toughness. Accordingly, the Zr content is preferably 0.005% to 0.1% in a situation in which Zr is added.

Y: 0.001% to 0.01%

Y forms a stable oxide at high temperature, effectively inhibits coarsening of prior γ grains in a heat-affected zone, and is an effective element to improve weld toughness, but these effects are poorly obtained if Y content is less than 0.001%. On the other hand, Y content of greater than 0.01% increases the amount of inclusions and reduces toughness. Therefore, Y content is preferably 0.001% to 0.01% in a situation in which Y is added.

Ca: 0.0005% to 0.0050%

Ca is a useful element to morphologically control sulfide inclusions. Ca content is 0.0005% or greater to display this effect. However, Ca content of greater than 0.0050% leads to a reduction in cleanliness and deterioration of toughness. Accordingly, the Ca content is preferably 0.0005% to 0.0050% in a situation in which Ca is added. The Ca content is more preferably 0.0005% to 0.0025%.

REMs: 0.0005% to 0.0100%

REMs have an effect of enhancing material properties by forming oxides and sulfides in the steel plate in the same way as Ca. REM content is 0.0005% or greater to obtain this effect. However, this effect reaches saturation if REM content is greater than 0.0100%. Accordingly, the REM content is preferably 0.0005% to 0.0100% in a situation in which REMs are added. The REM content is more preferably 0.0005% to 0.0050%.

We provide a type of steel for which the shear-type reverse transformation described above tends to readily occur and for which it is difficult to refine and homogenize prior γ grain size. The aforementioned type of steel can be classified by the equivalent carbon content thereof and excellent effects can be displayed when an equivalent carbon content $Ceq^{IIW}$ of the chemical composition defined by formula (1) is 0.65% or greater. Accordingly, we provide a steel plate having a chemical composition that, in addition to containing the basic components in the content ranges described above, has an equivalent carbon content $Ceq^{IIW}$ of 0.65% or greater.

$$Ceq^{IIW}=[\%\ C]+[\%\ Mn]/6+([\%\ Cu]+[\%\ Ni])/15+([\%\ Cr]+[\%\ Mo]+[\%\ V])/5\geq 0.65 \quad (1)$$

[% M] indicates the content (mass %) of an element M in the steel plate and has a value of 0 in a situation in which the element is not contained in the steel plate. Furthermore, the phrase "the element is not contained" refers to a situation in which the content of the element cannot be determined because the content is smaller than the detectable limit.

Accordingly, the equivalent carbon content $Ceq^{IIW}$ is calculated using formula (1') instead of formula (1) in a situation in which the optional additive components Cu, Mo, and V are not added.

$$Ceq^{IIW}=[\%\ C]+[\%\ Mn]/6+[\%\ Ni]/15+[\%\ Cr]/5\geq 0.65 \quad (1')$$

Next, the microstructure of the steel plate will be described.

Toughness has a strong correlation with prior γ grain size and tends to decrease with increasing prior γ grain size. In particular, due to the fact that fracturing starts from coarse prior γ grains, it is especially important to refine and homogenize prior γ grain size. A desired level of toughness can be reliably ensured through prior γ grain size in a mid-thickness part having a maximum value, expressed as an equivalent circle diameter, of 150 μm or less. The maximum value of prior γ grain size in the mid-thickness part is preferably 120 μm or less. The term "mid-thickness part" refers to a region at a depth of 45% to 55% of the plate thickness from the surface of the steel plate in a plate thickness direction (i.e., a region located centrally in the plate thickness direction and extending for 10% of the plate thickness). Conventional techniques, however, are not expected to enable reduction of the maximum value of prior γ grain size in the mid-thickness part to 150 μm or less.

Although no specific limitations are placed on prior γ grain size in surface layer parts of the steel plate, which are regions extending for 5% of the plate thickness in the plate thickness direction from opposite surfaces of the steel plate, prior γ grain size in the surface layer parts inevitably has a maximum value of 150 μm or less when prior γ grain size in the mid-thickness part has a maximum value of 150 μm or less.

Furthermore, it is important that the microstructure is a martensite and/or bainite microstructure. The same applies to the mid-thickness part. Specifically, it is important that a total area ratio of martensite and bainite in the mid-thickness part is 80% or greater. Adequate toughness of the mid-thickness part cannot be obtained if this total area ratio is less than 80%. The remainder of the microstructure is ferrite, pearlite or the like.

The "total area ratio of martensite and bainite in the mid-thickness part" is determined by inspecting the microstructure of a sample taken from the mid-thickness part. Specifically, the total area ratio is determined through observation under a scanning electron microscope for at least 50 observation fields at ×3000 magnification and through quantification of the microstructure.

As a result of the steel plate having the chemical composition and microstructure described above, the steel plate has excellent strength and toughness in the mid-thickness part thereof, despite having a plate thickness of 100 mm or greater. Specifically, it is possible to achieve a yield strength of 620 MPa or greater and a steel plate toughness at −40° C. ($vE_{-40°\ C.}$) of 170 J or greater. Alternatively, it is possible to achieve a yield strength of 690 MPa or greater and a steel plate toughness at −40° C. ($vE_{-40°\ C.}$) of 100 J or greater. Although no specific upper limit is set for the plate thickness, the plate thickness is, for example, 300 mm or less in a normal steel plate.

Next, a method of producing the steel plate will be described. Note that temperatures (° C.) described herein refer to the temperature of the mid-thickness part.

Semi-Finished Casting Product for Rolling

Molten steel adjusted to the chemical composition described above is produced by a normal steel making method such as using a converter, an electric heating furnace, or a vacuum melting furnace, and the molten steel is subsequently cast by a normal casting method such as continuous casting or ingot casting to obtain a semi-finished casting product for rolling such as a slab or a billet. In a situation in which there are restrictions in terms of rolling mill load and the like, blooming may be performed to reduce the plate thickness of the semi-finished casting product.

Heating Temperature of Semi-Finished Casting Product: $Ac_3$ temperature to 1200° C.

Next, the semi-finished casting product is heated to at least the $Ac_3$ temperature and no higher than 1200° C. Heating the semi-finished casting product to at least the $Ac_3$ transformation temperature is performed to homogenize the steel as a single austenite phase. Specifically, the heating temperature is preferably at least 1000° C. and no higher than 1200° C. The $Ac_3$ transformation temperature is taken to be a value calculated from formula (2).

$$Ac_3=937.2-476.5[\%\ C]+56[\%\ Si]-19.7[\%\ Mn]-16.3[\%\ Cu]-26.6[\%\ Ni]-4.9[\%\ Cr]+38.1[\%\ Mo]+124.8[\%\ V]+136.3[\%\ Ti]+198.4[\%\ Al]+3315[\%\ B] \quad (2)$$

[% M] indicates the content (mass %) of an element M in the semi-finished casting product.

Hot Rolling Conditions

Next, the semi-finished casting product is hot rolled to obtain a steel plate having a plate thickness of 100 mm or greater. In our composition, which is a composition for which refinement and homogenization of prior γ grain size do not readily occur during heat treatment, it is important that formation of coarse prior γ grains during hot rolling is inhibited. Promotion of recrystallization in γ regions, and in particular recrystallization in a latter part of rolling, is particularly effective to refine prior γ grains. When a steel plate having a plate thickness of 100 mm or greater is to be produced, it is difficult to perform sufficient working by hot rolling. Accordingly, preferably at least five passes of hot rolling are performed, and more preferably at least six passes and no more than eleven passes of hot rolling are performed. In a situation in which five or more passes are performed, recrystallization in a mid-thickness part can be effectively promoted and formation of coarse prior γ grains can be inhibited by performing each of at least three of the last five passes with a rolling reduction of 8% or greater. Moreover, it is even more effective to perform passes with a rolling reduction of 8% or greater in succession.

Three or four passes of hot rolling may be performed in a situation in which constraints due to the semi-finished casting product make it difficult to perform five or more passes of hot rolling. In a situation in which three or four passes are performed, recrystallization in the mid-thickness part can be effectively promoted and formation of coarse prior γ grains can be inhibited by performing at least one pass with a rolling reduction of 8% or greater and at least one other pass with a rolling reduction of 15% or greater.

Heat Treatment Conditions

Next, the steel plate is allowed to cool to a temperature of 300° C. or lower, is subsequently reheated to at least the $Ac_3$ temperature and no higher than 1050° C., and is subsequently rapidly cooled to 350° C. or lower from a temperature at least as high as an $Ar_3$ temperature. The reason that the reheating temperature is no higher than 1050° C. is that reheating the steel plate to a high temperature that is higher than 1050° C. causes austenite grain coarsening and noticeably reduces steel plate toughness. A reheating temperature lower than the $Ar_3$ temperature also leads to reduced steel plate toughness.

The reason that the cooling stop temperature is 350° C. or lower is that if the cooling stop temperature is higher than 350° C., steel plate toughness deteriorates due to non-uniform formation of carbides during a subsequent air cooling step and formation of coarse carbides during tempering. The $Ar_3$ transformation temperature is taken to be a value calculated using formula (3).

$$Ar_3=910-310[\%\ C]-80[\%\ Mn]-20[\%\ Cu]-15[\%\ Cr]-55[\%\ Ni]-80[\%\ Mo] \quad (3)$$

[% M] indicates the content (mass %) of an element M in the semi-finished casting product.

The temperature of the mid-thickness part is determined by simulation calculation or the like based on plate thickness, surface temperature, cooling conditions and so forth. For example, the temperature of the mid-thickness part may be determined by calculating a temperature distribution in the plate thickness direction by the finite difference method.

In industry, the method of rapid cooling is normally water cooling. However, a cooling method other than water cooling such as gas cooling or the like, may be adopted because the cooling rate is preferably as fast as possible.

Tempering Process Conditions

After rapid cooling, the steel plate is subjected to a tempering process to obtain a final product. The tempering temperature is at least 450° C. and no higher than 700° C. A tempering temperature of lower than 450° C. leads to reduced toughness due to the influence of low temperature tempering embrittlement, whereas a tempering temperature of higher than 700° C. causes precipitation of various carbides and leads to coarsening of steel plate microstructure and reduced strength.

In industry, quenching is sometimes repeated with an objective of steel toughening. In the same way, quenching may also be repeated. In a situation in which quenching is performed repeatedly, a final repetition of quenching is preferably performed with rapid cooling to 350° C. or lower after heating to at least the $Ac_3$ temperature and no higher than 1050° C., and subsequent tempering is preferably performed at 450° C. to 700° C.

EXAMPLES

Steels having the chemical compositions of steels 1-29 in Table 1 (note that the balance was Fe and incidental impurities) were produced by steel making, and continuously-cast slabs having slab thicknesses shown in Table 2 were produced from these steels. Each of the slabs was hot rolled under conditions shown in Table 2 to form a steel plate having a plate thickness shown in Table 2. Thereafter, each of the steel plates was subjected to heat treatment (quenching-tempering processes) under conditions shown in Table 2. As a result, final products were obtained for samples 1-37. The steel plates obtained as final products were tested as follows.

Tensile Test

A round bar tensile test piece (Ø=12.5 mm, GL=50 mm) was sampled from a mid-thickness part of each of the steel plates in a direction perpendicular to the rolling direction and used to measure yield strength (YS) and tensile strength (TS). The results are shown in Table 2.

Charpy Impact Test

Three 2-mm V-notch Charpy test pieces were sampled from the mid-thickness part of each of the steel plates with the rolling direction as a longitudinal direction of the test pieces. A Charpy impact test was conducted for each of the test pieces at a test temperature of −40° C. Absorbed energy ($vE_{-40°\ C.}$) in the test was measured and an average value of the measurements calculated. The results are shown in Table 2.

Maximum Value of Prior γ Grain Size

An optical microscope sample was taken from the mid-thickness part of each of the steel plates with a cut plane in the rolling direction as an observation plane. Prior γ grain boundaries were developed using picric acid and a micrograph captured at a magnification of ×200. The grain boundaries of all prior γ grains in the micrograph were traced, an equivalent circle diameter calculated for each of the prior γ grains by image analysis, and a maximum value of the equivalent circle diameters obtained. The results are shown in Table 2.

Total Area Ratio of MARTENSITe and Bainite

The total area ratio of martensite and bainite was obtained by the previously described method. The results are shown in Table 2.

TABLE 1

| Classification | Steel No. | Chemical composition (mass %) | | | | | | | | | | | | |
|---|---|---|---|---|---|---|---|---|---|---|---|---|---|---|
| | | C | Si | Mn | P | S | Cr | Ni | Ti | Al | N | B | Cu | Mo |
| Conforming steel | 1 | 0.085 | 0.20 | 1.60 | 0.006 | 0.0010 | 0.90 | 0.50 | 0.010 | 0.045 | 0.0032 | 0.0012 | 0.25 | 0.40 |
| | 2 | 0.097 | 0.35 | 1.40 | 0.005 | 0.0011 | 0.90 | 0.90 | — | 0.070 | 0.0055 | 0.0011 | 0.20 | 0.30 |
| | 3 | 0.108 | 0.15 | 1.30 | 0.006 | 0.0010 | 0.80 | 0.90 | 0.009 | 0.050 | 0.0030 | 0.0012 | 0.25 | 0.45 |
| | 4 | 0.116 | 0.19 | 1.14 | 0.005 | 0.0008 | 0.80 | 3.60 | — | 0.070 | 0.0060 | 0.0010 | 0.20 | 0.50 |
| | 5 | 0.123 | 0.21 | 1.15 | 0.004 | 0.0006 | 0.85 | 2.10 | — | 0.065 | 0.0055 | 0.0011 | 0.19 | 0.52 |
| | 6 | 0.127 | 0.20 | 1.15 | 0.003 | 0.0005 | 0.95 | 1.90 | 0.010 | 0.045 | 0.0035 | 0.0012 | 0.20 | 0.50 |
| | 7 | 0.143 | 0.20 | 1.15 | 0.005 | 0.0004 | 0.65 | 4.00 | — | 0.065 | 0.0050 | 0.0012 | 0.20 | 0.55 |
| | 8 | 0.155 | 0.05 | 0.90 | 0.005 | 0.0006 | 0.85 | 3.00 | 0.012 | 0.045 | 0.0030 | 0.0010 | 0.22 | 0.45 |
| | 9 | 0.163 | 0.15 | 1.10 | 0.005 | 0.0006 | 0.80 | 3.20 | — | 0.065 | 0.0055 | 0.0012 | 0.20 | 0.50 |
| | 10 | 0.175 | 0.35 | 2.50 | 0.004 | 0.0005 | — | 3.60 | 0.008 | 0.048 | 0.0029 | 0.0009 | 0.25 | — |
| | 11 | 0.118 | 0.26 | 0.60 | 0.003 | 0.0003 | 1.00 | 4.50 | 0.009 | 0.053 | 0.0025 | 0.0008 | — | 0.50 |
| | 12 | 0.190 | 0.05 | 1.80 | 0.005 | 0.0009 | 0.50 | 3.00 | 0.011 | 0.050 | 0.0028 | 0.0012 | — | — |
| | 13 | 0.140 | 0.22 | 1.10 | 0.005 | 0.0008 | 0.80 | 1.90 | 0.012 | — | 0.0025 | 0.0011 | 0.21 | 0.50 |
| | 14 | 0.145 | 0.08 | 0.55 | 0.003 | 0.0006 | 2.25 | 0.10 | — | 0.065 | 0.0040 | 0.0010 | — | 1.50 |
| | 15 | 0.135 | 0.25 | 1.00 | 0.003 | 0.0004 | 0.85 | 1.95 | 0.011 | 0.045 | 0.0033 | 0.0011 | 0.22 | 0.48 |
| | 16 | 0.142 | 0.18 | 1.05 | 0.004 | 0.0011 | 0.90 | 1.60 | 0.009 | 0.004 | 0.0044 | 0.0005 | 0.22 | 0.40 |
| | 17 | 0.115 | 0.22 | 1.13 | 0.006 | 0.0009 | 0.65 | 1.70 | 0.009 | 0.004 | 0.0028 | 0.0009 | 0.28 | 0.45 |
| | 18 | 0.122 | 0.29 | 1.16 | 0.005 | 0.0012 | 0.95 | 0.60 | 0.010 | 0.040 | 0.0030 | 0.0010 | 0.20 | 0.45 |
| | 19 | 0.118 | 0.20 | 1.15 | 0.006 | 0.0008 | 0.92 | 2.45 | 0.011 | 0.043 | 0.0036 | 0.0011 | 0.19 | 0.53 |
| Comparative steel | 20 | 0.228 | 0.21 | 1.25 | 0.004 | 0.0009 | 1.03 | 0.60 | 0.009 | 0.045 | 0.0032 | 0.0011 | 0.22 | 0.41 |
| | 21 | 0.144 | 0.55 | 1.02 | 0.006 | 0.0006 | 0.91 | 0.89 | 0.010 | 0.044 | 0.0028 | 0.0011 | 0.12 | 0.46 |
| | 22 | 0.085 | 0.39 | 0.30 | 0.01 | 0.0018 | 1.30 | 2.10 | 0.009 | 0.050 | 0.0032 | 0.0012 | 0.23 | 0.58 |
| | 23 | 0.129 | 0.33 | 1.25 | 0.025 | 0.0012 | 0.98 | 0.55 | 0.011 | 0.041 | 0.0032 | 0.0009 | 0.26 | 0.48 |
| | 24 | 0.153 | 0.18 | 1.33 | 0.009 | 0.0070 | 1.12 | 1.18 | 0.012 | 0.030 | 0.0029 | 0.0007 | 0.22 | 0.41 |
| | 25 | 0.118 | 0.24 | 1.35 | 0.007 | 0.0009 | 0.93 | 1.95 | — | 0.045 | 0.0045 | 0.0006 | — | 0.38 |
| | 26 | 0.123 | 0.29 | 1.45 | 0.005 | 0.0005 | 0.95 | 2.00 | 0.011 | 0.095 | 0.0038 | 0.0006 | 0.40 | 0.50 |
| | 27 | 0.132 | 0.28 | 1.35 | 0.009 | 0.0006 | 1.05 | 1.95 | 0.006 | 0.045 | 0.0078 | 0.0007 | 0.35 | 0.55 |
| | 28 | 0.135 | 0.33 | 1.10 | 0.01 | 0.0010 | 0.83 | 1.85 | 0.008 | 0.048 | 0.0035 | 0.0040 | 0.30 | 0.49 |

TABLE 1-continued

| | | | | | | | | | | | | | |
|---|---|---|---|---|---|---|---|---|---|---|---|---|---|
| 29 | 0.122 | 0.14 | 0.78 | 0.01 | 0.0015 | 0.55 | 1.15 | 0.012 | 0.038 | 0.0030 | 0.0009 | 0.10 | 0.53 |

| | Steel | Chemical composition (mass %) | | | | | | | | | $Ac_3$ | $Ar_3$ |
|---|---|---|---|---|---|---|---|---|---|---|---|---|
| Classification | No. | V | O | Mg | Ta | Zr | Y | Ca | REM | $Ceq^{IIW}$ | (° C.) | (° C.) |
| Conforming steel | 1 | 0.020 | 0.0010 | — | — | — | — | 0.0022 | — | 0.67 | 874 | 741 |
| | 2 | 0.045 | 0.0022 | — | — | — | — | 0.0018 | 0.0018 | 0.65 | 864 | 721 |
| | 3 | 0.040 | 0.0018 | — | — | — | — | 0.0017 | — | 0.66 | 865 | 714 |
| | 4 | 0.041 | 0.0020 | — | — | — | — | 0.0023 | — | 0.83 | 913 | 799 |
| | 5 | 0.040 | 0.0009 | — | — | — | — | 0.0019 | — | 0.75 | 775 | 551 |
| | 6 | 0.040 | 0.0023 | — | — | — | — | 0.0015 | — | 0.76 | 830 | 661 |
| | 7 | 0.040 | 0.0015 | — | — | — | — | 0.0018 | — | 0.86 | 826 | 614 |
| | 8 | 0.040 | 0.0022 | — | — | — | — | 0.0016 | — | 0.79 | 846 | 679 |
| | 9 | 0.040 | 0.0018 | — | — | — | — | — | 0.0016 | 0.84 | 873 | 741 |
| | 10 | — | 0.0021 | — | — | — | — | 0.0019 | — | 0.85 | 842 | 670 |
| | 11 | — | 0.0015 | — | — | — | — | — | — | 0.82 | 868 | 717 |
| | 12 | — | 0.0022 | — | — | — | — | 0.0013 | — | 0.79 | 845 | 684 |
| | 13 | 0.035 | 0.0024 | — | — | — | — | 0.0017 | — | 0.73 | 799 | 617 |
| | 14 | 0.190 | 0.0019 | — | — | — | — | — | — | 1.03 | 776 | 584 |
| | 15 | 0.043 | 0.0009 | 0.0016 | — | — | — | 0.0018 | — | 0.72 | 753 | 550 |
| | 16 | — | 0.0016 | — | 0.055 | — | — | 0.0021 | — | 0.70 | 730 | 517 |
| | 17 | 0.043 | 0.0022 | — | — | 0.0015 | — | 0.0025 | — | 0.66 | 708 | 483 |
| | 18 | 0.040 | 0.0019 | — | — | — | 0.0040 | 0.0012 | — | 0.66 | 685 | 450 |
| | 19 | 0.039 | 0.0018 | — | — | — | — | 0.0022 | — | 0.78 | 835 | 587 |
| Comparative steel | 20 | 0.036 | 0.0014 | — | — | — | — | 0.0019 | — | 0.79 | 850 | 708 |
| | 21 | — | 0.0013 | — | — | — | — | — | — | 0.66 | 848 | 688 |
| | 22 | 0.035 | 0.0014 | — | — | — | — | 0.0023 | — | 0.67 | 843 | 684 |
| | 23 | 0.039 | 0.0021 | — | — | — | — | — | 0.0018 | 0.69 | 823 | 669 |
| | 24 | 0.045 | 0.0016 | — | — | — | — | 0.0015 | — | 0.78 | 829 | 661 |
| | 25 | — | 0.0045 | — | — | — | — | 0.0016 | — | 0.74 | 807 | 636 |
| | 26 | — | 0.0008 | — | — | — | — | 0.0026 | — | 0.81 | 805 | 625 |
| | 27 | — | 0.0012 | — | — | — | — | — | — | 0.83 | 794 | 617 |
| | 28 | — | 0.0024 | — | — | — | — | 0.0022 | — | 0.73 | 799 | 610 |
| | 29 | 0.045 | 0.0013 | — | — | — | — | 0.0018 | — | 0.56 | 747 | 544 |

TABLE 2

| | | | Hot rolling | | | | | | | | | |
|---|---|---|---|---|---|---|---|---|---|---|---|---|
| | | | | | Pass rolling reduction (%) | | | | | | | |
| Classification | Sample | Steel No. | Heating temperature (° C.) | Slab thickness (mm) | Fifth last pass | Fourth last pass | Third last pass | Second last pass | Last pass | Total rolling reduction | Total number of rolling passes | Plate thickness (mm) |
| Examples | 1 | 1 | 1130 | 300 | 8 | 9 | 10 | 5 | 2 | 34 | 11 | 100 |
| | 2 | 2 | 1160 | 400 | 9 | 10 | 8 | 6 | 3 | 36 | 10 | 130 |
| | 3 | 3 | 1130 | 310 | 11 | 12 | 14 | 3 | 3 | 43 | 8 | 130 |
| | 4 | 3 | 1100 | 270 | 8 | 5 | 8 | 8 | 3 | 32 | 8 | 150 |
| | 5 | 4 | 1160 | 400 | 9 | 10 | 11 | 5 | 2 | 37 | 8 | 210 |
| | 6 | 5 | 1130 | 450 | 10 | 9 | 10 | 6 | 3 | 38 | 10 | 180 |
| | 7 | 6 | 1160 | 300 | 8 | 9 | 10 | 2 | 3 | 32 | 8 | 150 |
| | 8 | 7 | 1160 | 500 | 11 | 13 | 13 | 8 | 2 | 47 | 6 | 240 |
| | 9 | 8 | 1100 | 310 | 8 | 9 | 8 | 16 | 6 | 47 | 6 | 180 |
| | 10 | 9 | 1050 | 600 | 8 | 10 | 11 | 6 | 3 | 38 | 13 | 180 |
| | 11 | 10 | 1050 | 310 | 6 | 8 | 10 | 9 | 3 | 36 | 10 | 100 |
| | 12 | 11 | 1180 | 310 | 9 | 9 | 12 | 13 | 8 | 51 | 5 | 180 |
| | 13 | 12 | 1180 | 310 | 9 | 8 | 6 | 10 | 2 | 35 | 11 | 100 |
| | 14 | 13 | 1130 | 310 | 7 | 9 | 10 | 8 | 3 | 37 | 7 | 150 |
| | 15 | 14 | 1130 | 600 | 11 | 8 | 8 | 10 | 5 | 42 | 11 | 210 |
| | 16 | 15 | 1130 | 310 | 9 | 8 | 10 | 3 | 2 | 32 | 8 | 150 |
| | 17 | 16 | 1160 | 310 | 12 | 12 | 13 | 3 | 3 | 43 | 9 | 130 |
| | 18 | 17 | 1160 | 310 | 12 | 12 | 13 | 3 | 3 | 43 | 8 | 130 |
| | 19 | 18 | 1160 | 300 | 9 | 8 | 8 | 9 | 2 | 36 | 12 | 100 |
| | 20 | 19 | 1130 | 260 | — | — | 9 | 16 | 6 | 31 | 3 | 180 |
| | 21 | 19 | 1130 | 300 | 9 | 11 | 12 | 14 | 3 | 49 | 6 | 150 |
| Comparative examples | 22 | 20 | 1130 | 300 | 8 | 9 | 12 | 4 | 3 | 36 | 6 | 180 |
| | 23 | 21 | 1130 | 300 | 8 | 9 | 11 | 4 | 2 | 34 | 10 | 100 |
| | 24 | 22 | 1180 | 310 | 8 | 10 | 11 | 3 | 3 | 35 | 11 | 100 |
| | 25 | 23 | 1180 | 300 | 8 | 10 | 9 | 3 | 2 | 32 | 8 | 150 |
| | 26 | 24 | 1160 | 310 | 9 | 8 | 11 | 3 | 2 | 33 | 9 | 150 |
| | 27 | 25 | 1160 | 310 | 10 | 9 | 10 | 3 | 3 | 35 | 8 | 150 |
| | 28 | 26 | 1130 | 310 | 6 | 9 | 10 | 9 | 3 | 37 | 8 | 150 |
| | 29 | 27 | 1130 | 310 | 8 | 9 | 10 | 10 | 6 | 43 | 8 | 180 |

TABLE 2-continued

| | | | | | | | | | | | |
|---|---|---|---|---|---|---|---|---|---|---|---|
| 30 | 28 | 1160 | 310 | 8 | 9 | 10 | 9 | 3 | 39 | 10 | 150 |
| 31 | 29 | 1180 | 310 | 9 | 9 | 10 | 8 | 3 | 39 | 9 | 180 |
| 32 | 5 | 1130 | 450 | 8 | 8 | 3 | 2 | 3 | 24 | 10 | 180 |
| 33 | 5 | 1130 | 450 | 10 | 9 | 10 | 5 | 4 | 38 | 9 | 180 |
| 34 | 5 | 1130 | 450 | 9 | 8 | 8 | 3 | 2 | 30 | 10 | 180 |
| 35 | 5 | 1130 | 450 | 8 | 10 | 9 | 3 | 5 | 35 | 10 | 180 |
| 36 | 5 | 1130 | 450 | 10 | 8 | 11 | 2 | 3 | 34 | 10 | 180 |
| 37 | 3 | 1100 | 270 | — | — | 7 | 10 | 7 | 24 | 3 | 200 |

| | | Heat treatment conditions in final heat treatment | | | | Properties | | | Structure | |
|---|---|---|---|---|---|---|---|---|---|---|
| Classification | Sample | Reheating temperature (° C.) | Reheating time (minutes) | Cooling stop temperature (° C.) | Tempering temperature (° C.) | YS (MPa) | TS (MPa) | $vE_{-40° C.}$ (J) | Prior γ grain size (μm) | Martensite/bainite total area ratio (%) |
| Examples | 1 | 1000 | 30 | 150 | 660 | 708 | 822 | 175 | 88 | 85 |
| | 2 | 880 | 10 | 100 | 630 | 732 | 841 | 181 | 93 | 90 |
| | 3 | 900 | 30 | 100 | 600 | 815 | 864 | 173 | 75 | 90 |
| | 4 | 900 | 15 | 100 | 640 | 712 | 806 | 113 | 96 | 90 |
| | 5 | 880 | 30 | 150 | 645 | 715 | 815 | 188 | 92 | 90 |
| | 6 | 880 | 30 | 100 | 630 | 755 | 831 | 198 | 86 | 90 |
| | 7 | 880 | 30 | 100 | 650 | 712 | 803 | 185 | 79 | 90 |
| | 8 | 900 | 30 | 100 | 630 | 831 | 905 | 230 | 111 | 85 |
| | 9 | 880 | 30 | 100 | 640 | 722 | 813 | 198 | 89 | 85 |
| | 10 | 880 | 30 | 200 | 630 | 769 | 833 | 212 | 75 | 90 |
| | 11 | 900 | 30 | 100 | 630 | 748 | 821 | 233 | 91 | 85 |
| | 12 | 900 | 30 | 100 | 650 | 721 | 810 | 205 | 86 | 90 |
| | 13 | 880 | 30 | 150 | 650 | 739 | 812 | 195 | 83 | 85 |
| | 14 | 900 | 30 | 150 | 630 | 762 | 823 | 183 | 102 | 90 |
| | 15 | 980 | 60 | 100 | 670 | 703 | 785 | 192 | 122 | >95 |
| | 16 | 900 | 30 | 150 | 630 | 726 | 811 | 195 | 96 | 90 |
| | 17 | 900 | 30 | 100 | 630 | 741 | 832 | 178 | 88 | 90 |
| | 18 | 900 | 30 | 100 | 630 | 745 | 829 | 173 | 86 | 85 |
| | 19 | 900 | 30 | 150 | 630 | 763 | 841 | 192 | 96 | 90 |
| | 20 | 900 | 30 | 150 | 630 | 750 | 832 | 183 | 85 | 90 |
| | 21 | 900 | 30 | 100 | 680 | 632 | 728 | 193 | 98 | >95 |
| Comparative examples | 22 | 900 | 30 | 100 | 600 | 796 | 910 | 51 | 142 | >95 |
| | 23 | 900 | 10 | 150 | 660 | 713 | 806 | 48 | 98 | >95 |
| | 24 | 900 | 30 | 150 | 660 | 612 | 762 | 33 | 96 | 80 |
| | 25 | 900 | 30 | 150 | 630 | 738 | 824 | 18 | 124 | >95 |
| | 26 | 900 | 30 | 150 | 630 | 754 | 833 | 26 | 89 | 90 |
| | 27 | 900 | 30 | 150 | 630 | 703 | 821 | 15 | 86 | 85 |
| | 28 | 900 | 30 | 150 | 630 | 751 | 846 | 65 | 92 | >95 |
| | 29 | 900 | 30 | 150 | 630 | 728 | 831 | 22 | 87 | >95 |
| | 30 | 900 | 30 | 100 | 630 | 592 | 682 | 29 | 103 | 65 |
| | 31 | 900 | 30 | 100 | 630 | 585 | 673 | 63 | 98 | 45 |
| | 32 | 950 | 30 | 150 | 600 | 892 | 961 | 32 | 273 | >95 |
| | 33 | 1100 | 30 | 150 | 600 | 812 | 921 | 65 | 249 | >95 |
| | 34 | 750 | 30 | 100 | 600 | 605 | 828 | 41 | 253 | 45 |
| | 35 | 880 | 30 | 470 | 600 | 512 | 803 | 45 | 122 | 40 |
| | 36 | 880 | 30 | 150 | 730 | 592 | 683 | 206 | 83 | 80 |
| | 37 | 900 | 30 | 150 | 600 | 706 | 822 | 63 | 260 | >95 |

As shown in Table 2, in our examples in terms of chemical composition, maximum value of prior γ grain size, and total area ratio of martensite and bainite (i.e., samples 1-21), the obtained steel plates were confirmed to have excellent strength and toughness. Specifically, in each of these examples, YS was 620 MPa or greater, TS was 720 MPa or greater, and toughness at −40° C. ($vE_{-40° C.}$) was 170 J or greater, or YS was 690 MPa or greater, TS was 720 MPa or greater, and toughness at −40° C. ($vE_{-40° C.}$) was 100 J or greater.

In contrast, in the comparative examples for which the chemical composition was out of our scope (i.e., samples 20-29) and comparative examples for which the microstructure of the steel plate was out of our scope due to the production conditions being out of our scope (i.e., samples 32-37), we confirmed that at least one of YS, TS, and toughness was poor.

The invention claimed is:

1. A steel plate having;

a chemical composition containing, by mass %:

0.08% to 0.20% of C;
0.40% or less of Si;
0.5% to 5.0% of Mn;
0.015% or less of P;
0.0050% or less of S;
0% to 3.0% of Cr;
0% to 5.0% of Ni;
0% to 0.080% of Al;
0.0070% or less of N;
0.0030% or less of B;
0.0025% or less of O, and
the balance being Fe and incidental impurities, wherein the chemical composition satisfies relationship (1), $$Ceq^{IIW}=[\%\ C]+[\%\ Mn]/6+([\%\ Cu]+[\%\ Ni])/15+([\%\ Cr]+[\%\ Mo]+[\%\ V])/5\geq 0.65 \quad (1)$$

where [% M] indicates content of an element M in the steel plate by mass % and has a value of 0 when the element M is not contained in the steel plate, a microstructure in which:

prior γ grain size in a mid-thickness part of the steel plate has a maximum value, expressed as an equivalent circle diameter, of 150 μm or less; and a total area ratio of martensite and bainite in the mid-thickness part is 80% or greater, and a yield strength of 620 MPa or greater and a plate thickness of 100 mm or greater.

2. The steel plate of claim 1, wherein the chemical composition further contains, by mass %, one or more selected from:

0.50% or less of Cu;
1.50% or less of Mo;
0.200% or less of V;
0.005% to 0.020% of Ti;
0.0001% to 0.002% of Mg;
0.01% to 0.20% of Ta;
0.005% to 0.1% of Zr;
0.001% to 0.01% of Y;
0.0005% to 0.0050% of Ca; and
0.0005% to 0.0100% of REMs.

3. A method of producing the steel plate of claim 1, comprising:

heating a semi-finished casting product having the chemical composition to at least an $Ac_3$ temperature and no higher than 1200° C.;

subsequently subjecting the semi-finished casting product to three or more passes of hot rolling to obtain a steel plate having a plate thickness of 100 mm or greater;

subsequently reheating the steel plate to at least the $Ac_3$ temperature and no higher than 1050° C.;

subsequently rapidly cooling the steel plate to 350° C. or lower from a temperature equal to or higher than an $Ar_3$ temperature; and subsequently subjecting the steel plate to a tempering process at a temperature of at least 450° C. and no higher than 700° C., wherein when the hot rolling consists of three or four passes, at least one pass is performed with a rolling reduction of 8% or greater and at least one other pass is performed with a rolling reduction of 15% or greater, and when the hot rolling consists of five or more passes, at least three of the last five passes are each performed with a rolling reduction of 8% or greater.

4. A method of producing the steel plate of claim 2, comprising:

heating a semi-finished casting product having the chemical composition to at least an $Ac_3$ temperature and no higher than 1200° C.;

subsequently subjecting the semi-finished casting product to three or more passes of hot rolling to obtain a steel plate having a plate thickness of 100 mm or greater;

subsequently reheating the steel plate to at least the $Ac_3$ temperature and no higher than 1050° C.;

subsequently rapidly cooling the steel plate to 350° C. or lower from a temperature equal to or higher than an $Ar_3$ temperature; and subsequently subjecting the steel plate to a tempering process at a temperature of at least 450° C. and no higher than 700° C., wherein when the hot rolling consists of three or four passes, at least one pass is performed with a rolling reduction of 8% or greater and at least one other pass is performed with a rolling reduction of 15% or greater, and when the hot rolling consists of five or more passes, at least three of the last five passes are each performed with a rolling reduction of 8% or greater.

* * * * *